US007587882B2

(12) United States Patent
Rocholl et al.

(10) Patent No.: US 7,587,882 B2
(45) Date of Patent: Sep. 15, 2009

(54) METHOD FOR THE OPERATION OF A PACKAGE EMPTYING STATION

(75) Inventors: Timothy Rocholl, Hamm (DE); Jan Hecht, Pfaffenhofen (DE)

(73) Assignee: Hecht Anlagenbau GmbH, Pfaffenhofen/Ilm (DE)

( * ) Notice: Subject to any disclaimer, the term of this patent is extended or adjusted under 35 U.S.C. 154(b) by 71 days.

(21) Appl. No.: 11/931,355

(22) Filed: Oct. 31, 2007

(65) Prior Publication Data

US 2008/0101901 A1 May 1, 2008

(30) Foreign Application Priority Data

Oct. 31, 2006 (DE) ..... 10 2006 051 513

(51) Int. Cl.
*B65B 69/00* (2006.01)

(52) U.S. Cl. ..... 53/469; 53/492; 53/576; 53/381.2; 414/412; 414/810

(58) Field of Classification Search ..... 53/459, 53/469, 492, 567, 576, 381.1, 381.2; 414/412, 414/810; *B65B 69/00*
See application file for complete search history.

(56) References Cited

U.S. PATENT DOCUMENTS 4,504,183 A * 3/1985 Bennison et al. ..... 53/381.2
4,627,781 A * 12/1986 Borgner ..... 414/412
5,222,511 A 6/1993 Mikkelsen et al.
5,735,321 A * 4/1998 Martyn et al. ..... 141/114
5,791,123 A * 8/1998 Bolz ..... 53/469
5,816,772 A * 10/1998 Py ..... 414/412
5,870,886 A * 2/1999 Norton ..... 53/381.2
6,254,330 B1 * 7/2001 Steffen et al. ..... 414/421
6,653,377 B1 * 11/2003 Lloyd et al. ..... 524/221
2003/0090174 A1 5/2003 Ryder

FOREIGN PATENT DOCUMENTS

DE 31 40 467 A1 4/1983
DE 86 19 340.6 U1 10/1987
EP 0 520 183 A1 12/1992
JP 02045327 A * 2/1990
WO 2005/056443 A1 6/2005

* cited by examiner

*Primary Examiner*—Stephen F Gerrity
(74) *Attorney, Agent, or Firm*—David S. Safran; Roberts Mlotkowski Safran & Cole, P.C.

(57) ABSTRACT

A method for operating a package emptying station having a work station, in which an emptying step is performed, an inlet via which the package to be emptied is inserted into the work station, an outlet via which the emptied package is ejected, and a product outlet through which the emptied contents of the package is discharged. Continuous tubular film packs are provided both at the inlet and also at the package outlet which seal off the inlet and the outlet and encase the package to be emptied or the emptied package during the insertion or corresponding ejection of the package. The film is sealed off and severed between individual packages such that the interior and the exterior do not come into contact. In this manner, both contamination of the package contents by environmental substances and also any contamination of the environment by the package contents can be avoided.

2 Claims, 8 Drawing Sheets

METHOD FOR THE OPERATION OF A PACKAGE EMPTYING STATION

BACKGROUND OF THE INVENTION

1. Field of the Invention

The invention concerns a method for the operation of a package emptying station, which has a work station, in which a step of emptying a package is executed, an inlet into the work station, via which the package to be emptied is inserted into the work station, and a product outlet through which emptied contents of the package are discharged. The invention is also directed to such a method in which the emptied package is ejected from the work station via an outlet.

2. Description of Related Art

At the present time, a high level of cleanliness is required in the manufacture of products in many industrial sectors. It is self-evident that, in the manufacture of chemicals or pharmaceuticals, care must be taken that source materials or products to be processed are not contaminated. It is not only the quality of the products or the source materials that plays a part in this regard, but also the protection of people. Employees who come into contact with substances that are dangerous or hazardous to health must be protected from damaging levels of exposure. The introduction of a source material or a product to be processed into the production process is often problematical, because it is difficult to integrate both testing of the source material supplied and the delivery containers of various manufacturers into an automated testing process. For this reason this step is often executed manually by employees.

SUMMARY OF THE INVENTION

A primary object of the present invention is to create a method for the operation of a package emptying station in which any hazards to a person or contamination of the environment is avoided.

This object is achieved according to the invention by a method having the following steps:

(a) encasement of the inlet with a continuous tubular film whose inlet end is sealed off, (b) introduction of at least one package to be emptied through the inlet, wherein the sealed-off continuous tubular film is pulled into the work station with the package, and encases the at least one package, (c) sealing-off of the continuous tubular film behind the at least one package encased by the continuous tubular film, and (d) extraction of the contents of the at least one package in the work station.

In accordance with an alternative embodiment, the invention comprises the steps of:

(a) encasement of the inlet with a continuous tubular film, whose end encasing the inlet is sealed off, (b) connection of the container with the sealed-off endless tubular film encasing the inlet, without opening the sealed-off end, (c) opening of the sealed-off end of the continuous tubular film, (d) introduction of the contents of the container into the work station, (e) sealing-off the continuous tubular film at two locations between the inlet and the container, (f) cutting the continuous tubular film between the two locations.

In what follows, two preferred embodiments of the invention are explained in detail with reference to the accompanying drawings.

DETAILED DESCRIPTION OF THE INVENTION

Figure 1:
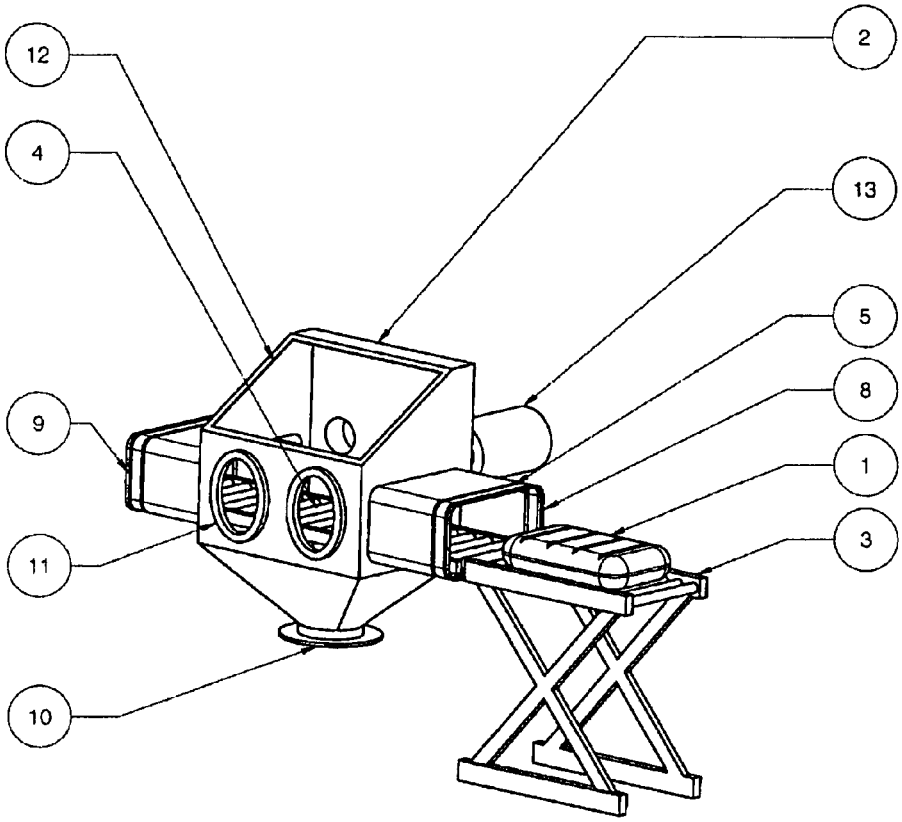
FIG. 1 is a perspective view of a package emptying station.

FIG. 1 shows a package emptying station in the initial position in which a package 1 to be emptied has been brought into an insertable position by means of a lifting table 3. The package emptying station is also fitted with a roller conveyor 4 via which the package to be emptied can be conveyed through the package emptying station, a work station 2, in which the package to be emptied is emptied and which is provided with a viewing window 12 and with glove inserts 11 for access into the work station 2. The package 1 is inserted into the package emptying station via an inlet 5 and after the emptying process is ejected via an outlet 9.

Figure 2:
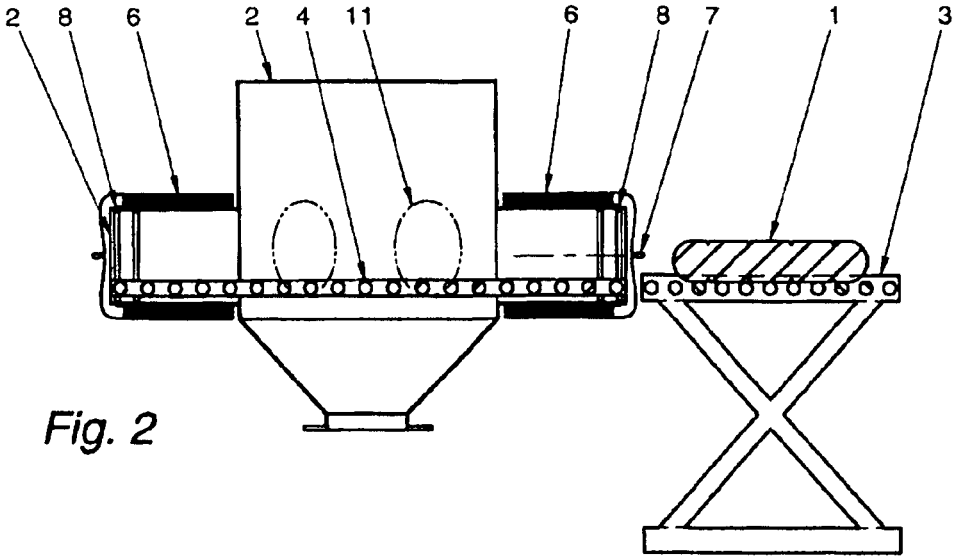
FIG. 2 is a side view of the package emptying station before the insertion of a package.

In this first embodiment, the outlet 9 is not absolutely necessary. It is also possible for a desired number of packages to be inserted into the package emptying station and subsequently ejected once via the inlet 5. The emptied contents of the package 1 can be supplied to a further production step via a product outlet 10. In FIG. 2, a package 1 has been brought into an insertable position by means of the lifting table 3 and the interior of the package emptying station is sealed off from the external environment by means of a continuous tubular film 6, which is positioned both at the inlet 5 and also at the outlet 9. For this purpose the continuous tubular film 6 is sealed off at a film sealing station 7.

Figure 3:
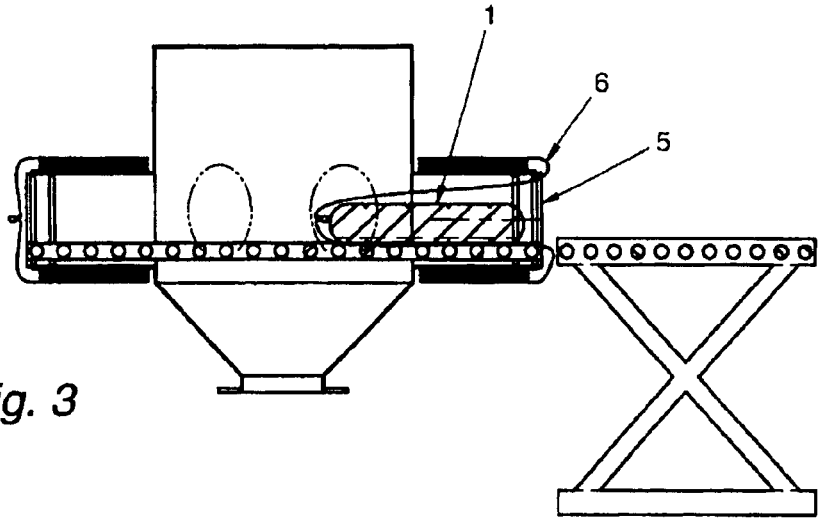
FIG. 3 is a side view of the package emptying station during the insertion of a package.
Figure 4:
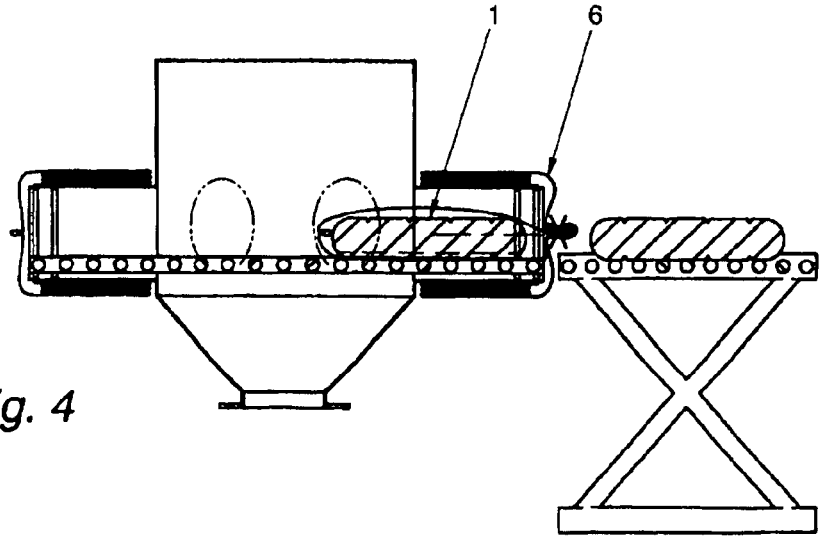
FIG. 4 is a side view of a package emptying station, in which a package is encased by a continuous tubular film and the endless tubular film is resealed behind the package.

FIG. 3 shows an insertion event for the package 1, in which the package is introduced through the inlet 5 into the work station, and the package pulls the endless tubular film 6 with it into the interior. FIG. 4 shows the continuous tubular film 6 having been sealed off behind the package 1, as a result of which the package 1, arrives in the interior of the package emptying station encased by the continuous tubular film 6 so that the interior of the package emptying station is out of contact with the external environment. Depending on the size of the package, or the user's mode of operation, the continuous tubular film 6 need not be sealed off after the first package. It is also possible to introduce a plurality of packages into the inlet 5 and to seal off the continuous tubular film only after a certain number of packages have been introduced. The same also applies to the ejection of the empty packages at the outlet 5.

Figure 5:
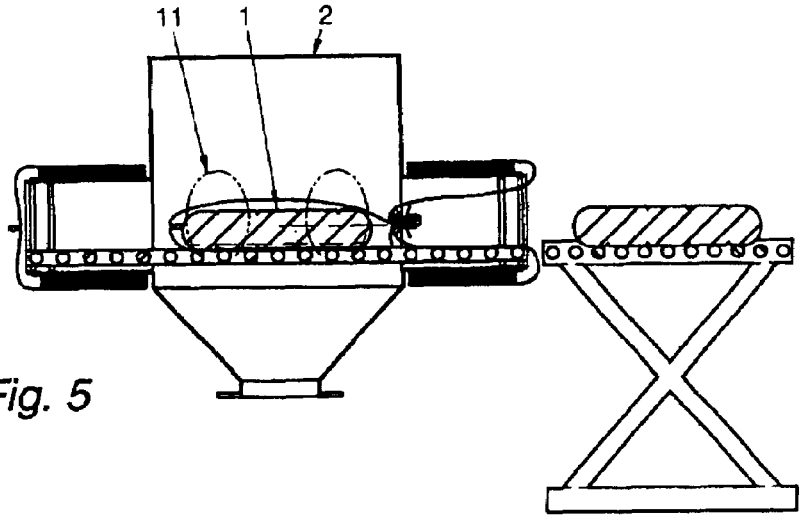
FIG. 5 is a side view of the package emptying station with an encased package that is ready to open, which has been pulled into the centre by means of the glove inserts.

The package 1, encased by the endless tubular film, can be pulled by a user into the center of the work station by means of the glove inserts 11 (FIG. 5), while a further package can then be pushed into the inlet 5. Depending on the procedure desired, the continuous tubular film 6, which encases the package, can be sealed at the sealing station after a certain number of packages have been inserted such that the inlet is sealed off.

Figure 6:
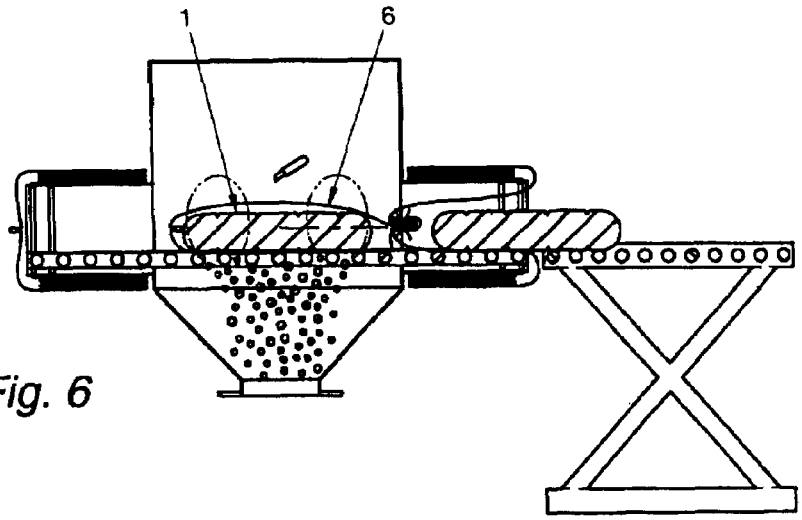
FIG. 6 is a side view of the package emptying station during the cutting process and the falling of the product into the product outlet.
Figure 7:
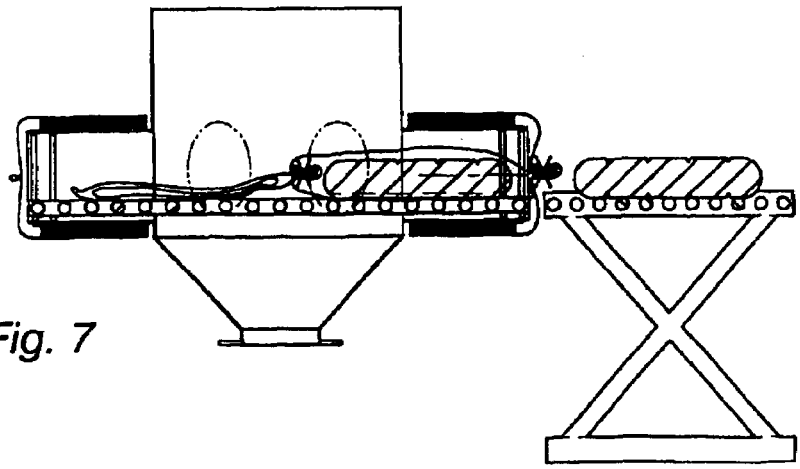
FIG. 7 is a side view of the package emptying station, in which a first package has been emptied, and into which a second has already been inserted, and the continuous tubular film has again been sealed behind the second package.
Figure 8:
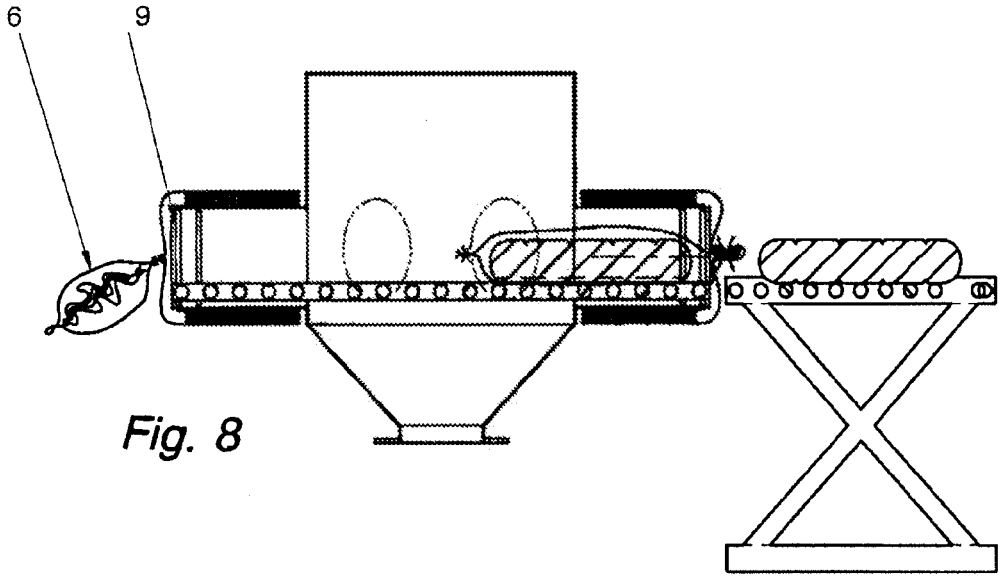
FIG. 8 is a side view of the package emptying station, in which one package has already been ejected, a second has already been encased, and a third is positioned ready for insertion.

During an emptying process as in FIG. 6, which is executed by slicing through the film 6, the package contents are discharged into a product outlet 10. After the package has been emptied, a second package, behind which the continuous tubular film 6 is in turn sealed off, can be pulled into the work station, as shown in FIG. 7, and a third package can be brought into a position in which it can be inserted. As a final step, the residual film and the empty package are ejected from the work station 2 by means of a second continuous tubular film 6, as shown in FIG. 8, without coming into contact with the external environment. For this purpose the second continuous tubular film, after it has encased at least one empty package, is bound twice and severed between the bound locations.

Figure 9:
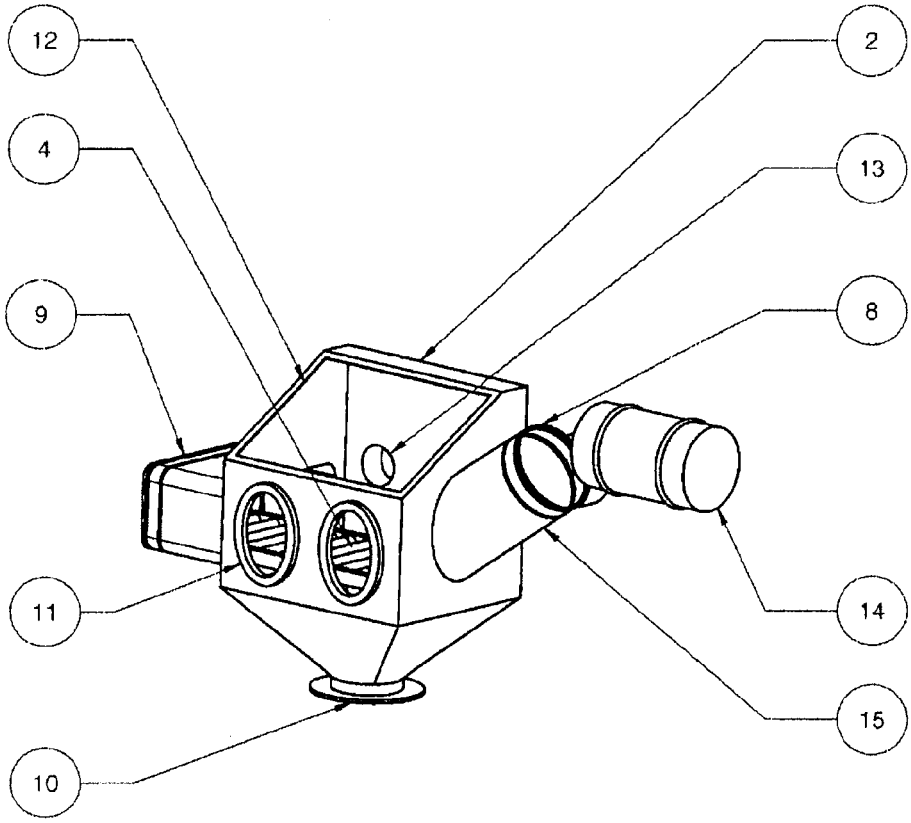
FIG. 9 is a perspective view of a package emptying station for use in a second preferred embodiment of the invention, for the case in which the package to be emptied is contained in a container.

FIG. 9 shows a package emptying station in accordance with a second preferred embodiment. The package emptying station differs from the first preferred embodiment in that a container 14, e.g., a drum, which contains the package that is to be emptied, can be connected with the inlet. The inlet, preferably a connecting tube 15, is inclined in order that the contents of the container 14 can slide out of the container 14 into the work station.

Figure 10:
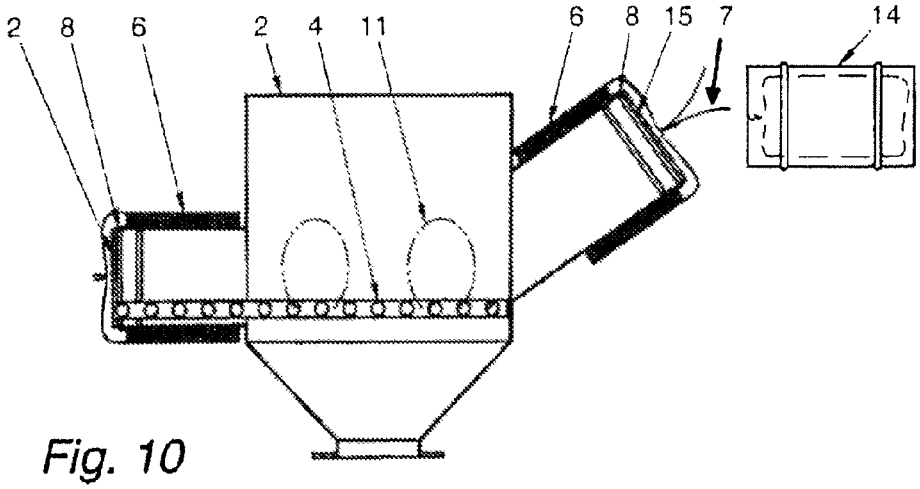
FIG. 10 is a side view of the package emptying station of the second preferred embodiment, in which a container containing the package to be emptied is positioned ready for insertion.
Figure 11:
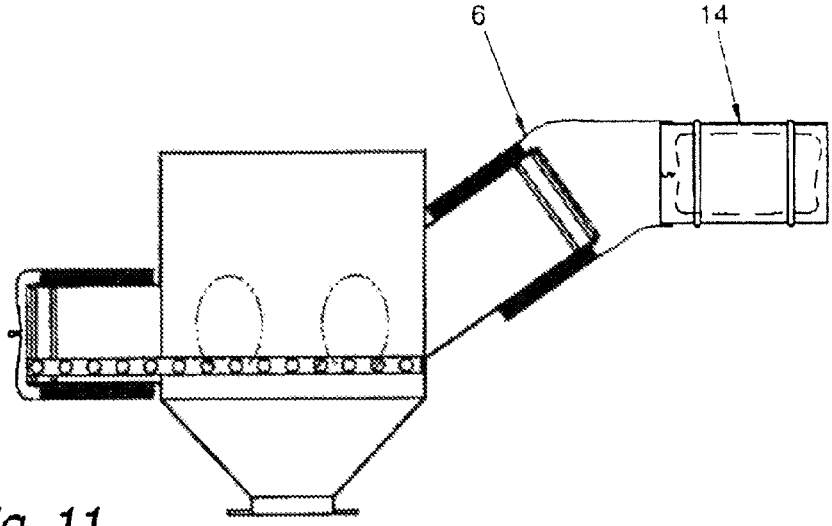
FIG. 11 is a side view of the package emptying station of the second preferred embodiment, in which a container containing the package to be emptied is connected with the inlet.
Figure 12:
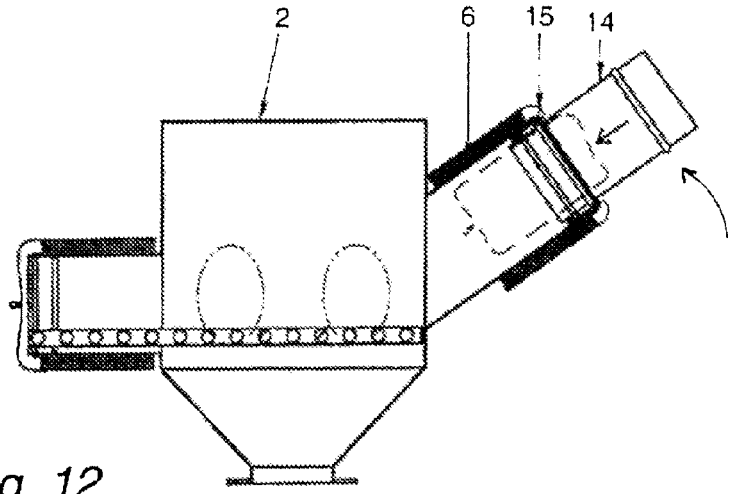
FIG. 12 is a side view of the package emptying station of the second preferred embodiment, in which a package is being inserted into the package emptying station.
Figure 13:
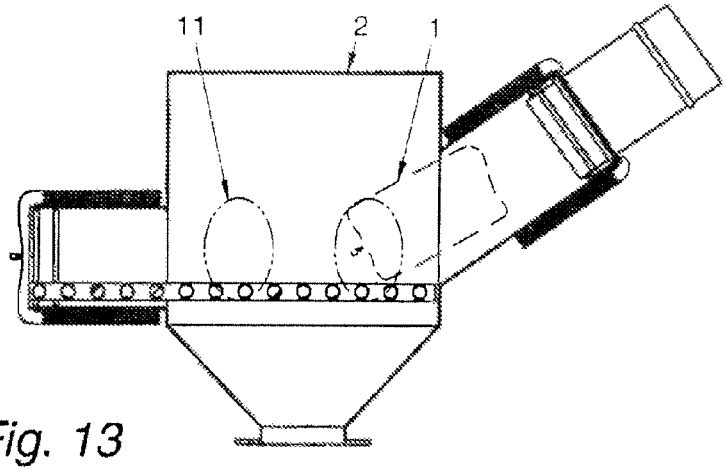
FIG. 13 is a side view of the package emptying station of the second preferred embodiment, in which a package is sliding through the connecting tube into the work station.
Figure 14:
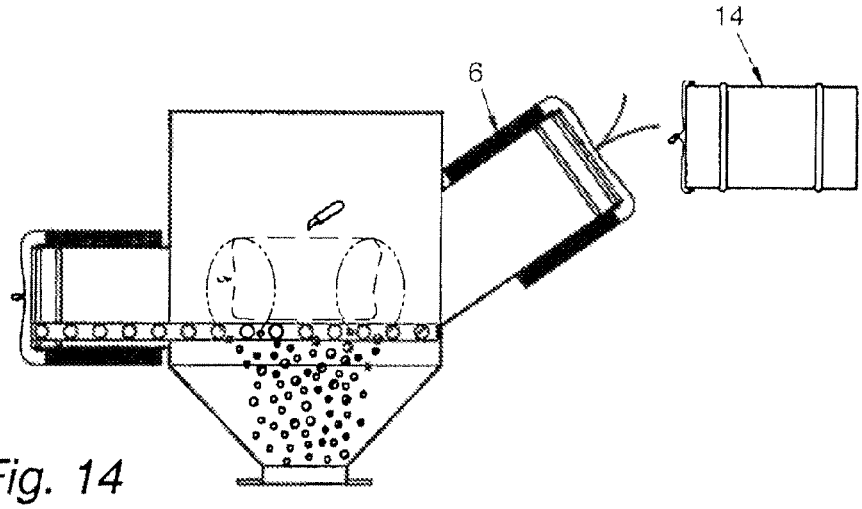
FIG. 14 is a side view of the package emptying station of the second preferred embodiment, in which a package has already been opened and the container has been separated from and is outside of the package emptying station.
Figure 15:
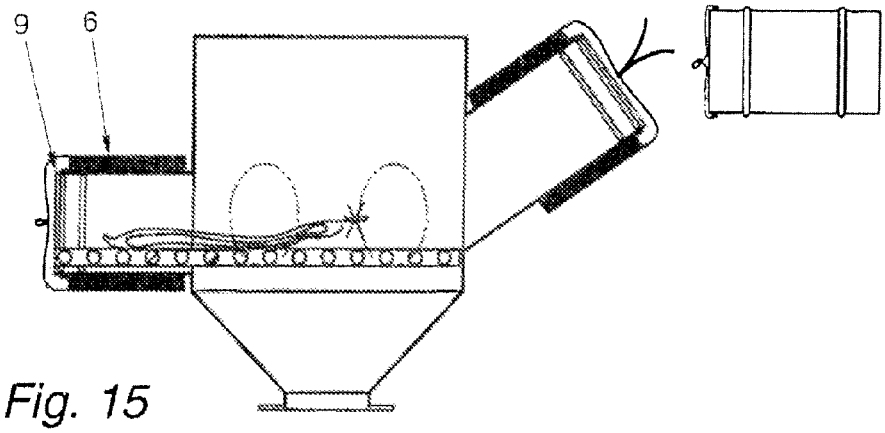
FIG. 15 shows a side view of the package emptying station of the second preferred embodiment, in which a package has been emptied and the container outside the package emptying station is separated from the former according to the invention.
Figure 16:
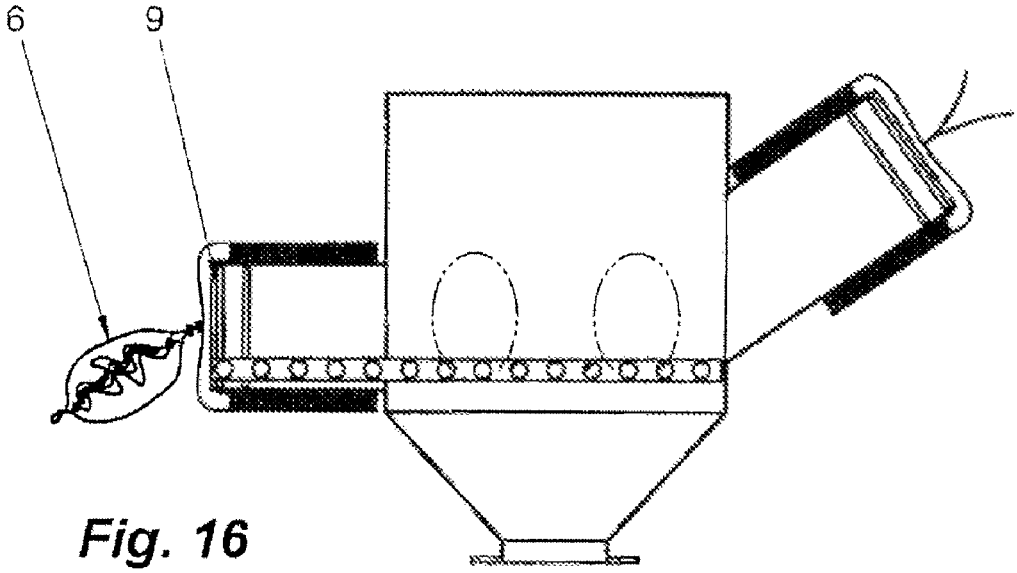
FIG. 16 is a side view of the package emptying station of the second preferred embodiment, in which an emptied package has been ejected in accordance with the invention.

FIG. 10 shows an initial position in which the connecting tube and the outlet 9 are sealed off by a continuous tubular film 6. The container 14 containing the package to be emptied is brought into a connectable position by means of a lifting device. After the container 14 has been brought into this position and opened, the continuous tubular film 6 is connected with the container 14 by means of a connecting device, preferably an O-ring, and the sealing station of the continuous tubular film 6 is opened. If the container 14 is now connected with the connecting tube 15, the contents slide through the continuous tubular film 6 into the work station 2. After the emptying, the container is separated from the connecting tube such that the continuous tubular film 6 connected with the container 14 seals off both the container 14 and the connecting tube 15, so that the interior of the container 14 and the work station 2 do not come into contact with the external environment. Then, by sealing off the film 6 twice between the container 14 and the connecting tube 15 and severing the film between the sealed locations, the container 14 can be taken away in a closed condition and the package emptied as shown in FIG. 14. The emptied package and first film can then be encased within a second film 6 and removed from the work station 2 as shown in FIG. 16; this step is the same as in the first embodiment.

What is claimed is:

1. A method for the operation of a package emptying station, which has a work station, an inlet into the work station, a package outlet from the work station via which an emptied package is ejected, and a product outlet through which emptied contents of the package are discharged, comprising the steps of:

(a) encasing the inlet with a continuous tubular film, an end of which is sealed off, (b) connecting a container, in which a package to be emptied is located, with the continuous tubular film without opening the sealed-off end, (c) opening the sealed-off end of the continuous tubular film, (d) introducing the package into the work station through the continuous tubular film, (e) sealing-off the continuous tubular film at two locations between the inlet and the container, (f) severing the continuous tubular film between the two sealed off locations, and (g) extracting the contents of the package in the work station.

2. The method according to claim 1, comprising the further steps of:

(h) encasing the package outlet with a second continuous tubular film and sealing-off of an outlet end encasing of the second continuous tubular film, (i) ejecting the empty package from the work station through the package outlet into the second continuous tubular film so as to encase the package within the second continuous tubular film, (j) sealing-off the second continuous tubular film at two locations behind the ejected package, and (k) severing the second continuous tubular film between the two sealed off locations.

* * * * *